US005249487A

United States Patent [19]

Armfield, IV

[11] Patent Number: 5,249,487

[45] Date of Patent: Oct. 5, 1993

[54] OPEN-END RATCHET WRENCH

[76] Inventor: Samuel L. Armfield, IV, 605 Daisy Dr., Mars, Pa. 16046

[21] Appl. No.: 972,368

[22] Filed: Nov. 5, 1992

[51] Int. Cl.[5] ..... B25B 13/00

[52] U.S. Cl. ..... 81/58; 81/60; 81/186; 81/418

[58] Field of Search ..... 81/58, 58.2, 60, 61, 81/186, 418

[56] References Cited

U.S. PATENT DOCUMENTS

| | | | |
|---|---|---|---|
| 847,251 | 3/1907 | Hodson . | |
| 2,550,010 | 4/1951 | Kavalar | 81/58 |
| 2,712,259 | 7/1955 | Cowell | 81/179 |
| 3,165,015 | 1/1965 | Hinrichs | 81/179 |
| 4,276,790 | 7/1981 | Davis | 81/111 |
| 4,554,847 | 11/1985 | DeSantis | 81/111 |
| 4,644,830 | 2/1987 | Bailey et al. | 81/58.2 |
| 4,770,070 | 9/1988 | Sowers | 81/61 |
| 5,018,412 | 5/1991 | Wylie, III | 81/111 |

*Primary Examiner*—James G. Smith

*Attorney, Agent, or Firm*—Carothers & Carothers

[57] ABSTRACT

An open-end ratchet wrench is shown which has a handle and a generally C-shaped head at one end of the handle providing a pair of open-ended jaws with spaced confronting jaw faces. The jaws are provided in the form of a plurality of rotatable toothed gears which are presized and prealigned to engage and rotate about the angular side surfaces of a nut or bolt head to be received between the jaws for turning. A ratchet mechanism is also provided for selectively preventing rotation of at least one of the gears in one direction.

12 Claims, 2 Drawing Sheets

OPEN-END RATCHET WRENCH

BACKGROUND OF THE INVENTION

This invention relates to a novel improvement in ratchet tools having open-ended jaws, and more particularly to such a tool wherein the jaw faces can be ratcheted to permit the tool to be rotated in only one direction around a nut or bolt head.

Open-ended ratchet wrenches and pliers have been designed in many different forms or configurations. They are necessary to provide the tightening or loosening of a threaded bolt or nut in tight or limited spaces.

However, there are no practical open-ended wrenches with ratchet means which have cooperating jaw faces that are economical to construct and manufacturer. Those already available or patented, require too many moving and intricate parts, thereby making the cost of construction prohibitive and noncompetive.

It is a principal object of the present invention to provide a novel open-ended ratchet wrench which is effective, yet extremely simple to construct or manufacture.

SUMMARY OF THE INVENTION

The open-end ratchet wrench of the present invention is provided with a pair of open-ended jaws with spaced confronting jaw faces and a support or handle for the jaws. Each jaw includes a plurality of freely rotating gears with circumferential gear teeth. A portion of these gear teeth of each jaw make up the confronting faces of the wrench jaws.

The open-ended jaws are thus provided in the form of a generally C-shaped head at one end of a handle, and these rotatable toothed gears constitute the confronting jaw faces which will engage and/or rotate about a bolt head or a nut to be tightened or loosened.

A ratchet device is provided to prevent rotation of at least one of these gears in one direction in order to provide the necessary ratchet action for tightening or loosening the bolt or nut head.

The gears are non-meshing in order to permit the gears to freely rotate about the bolt or nut without interfering with each other.

In the preferable configuration, the jaws each consist of two prepositioned gears. Obviously more gears, such as, three or four may be provided for each jaw.

The ratchet device to prevent rotation of at least one of the gears in one direction may be of any conventional structure, such as, a spring loaded dog or a steel spring lever arm.

The open-end ratchet wrench of the present invention may be provided in several forms including: an open-ended wrench, scissor-type pliers, slip-type pliers, vice grip pliers, and in the form of a crescent wrench..

The gears forming the jaw faces are prepositioned for rolling over corners and faces of a given nut or bolt head size. Also, the size and spacing of the teeth of these gears may be selected for properly engaging corners or faces of a given size nut or bolt head.

BRIEF DESCRIPTION OF THE DRAWINGS

Other objects and advantages appear in the following description and claims.

The accompanying drawings show, for the purpose of exemplification, without limiting the invention or the claims thereto, certain practical embodiments illustrating the principals of this invention, wherein:

DETAILED DESCRIPTION OF THE PREFERRED EMBODIMENTS

Figure 1:
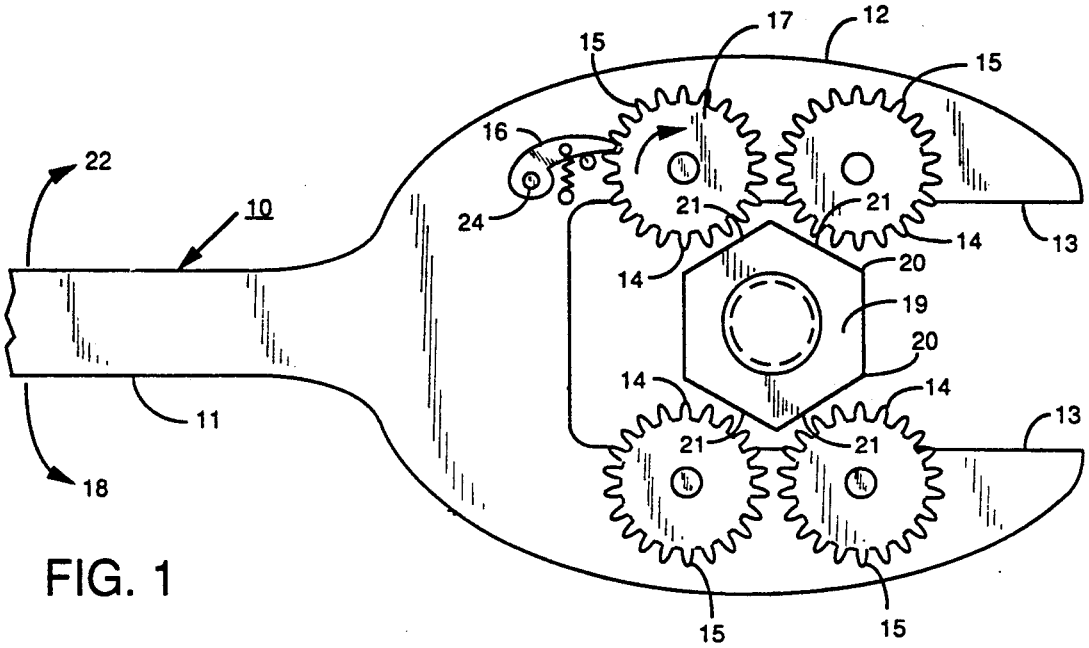
FIG. 1 is a side view of a preferred embodiment of the tool of the present invention in the form of an open-ended wrench with a portion of the handle broken away and shown just after a nut has been rotated by arcuate movement of the tool, or just before rotation of the nut.
Figure 2:
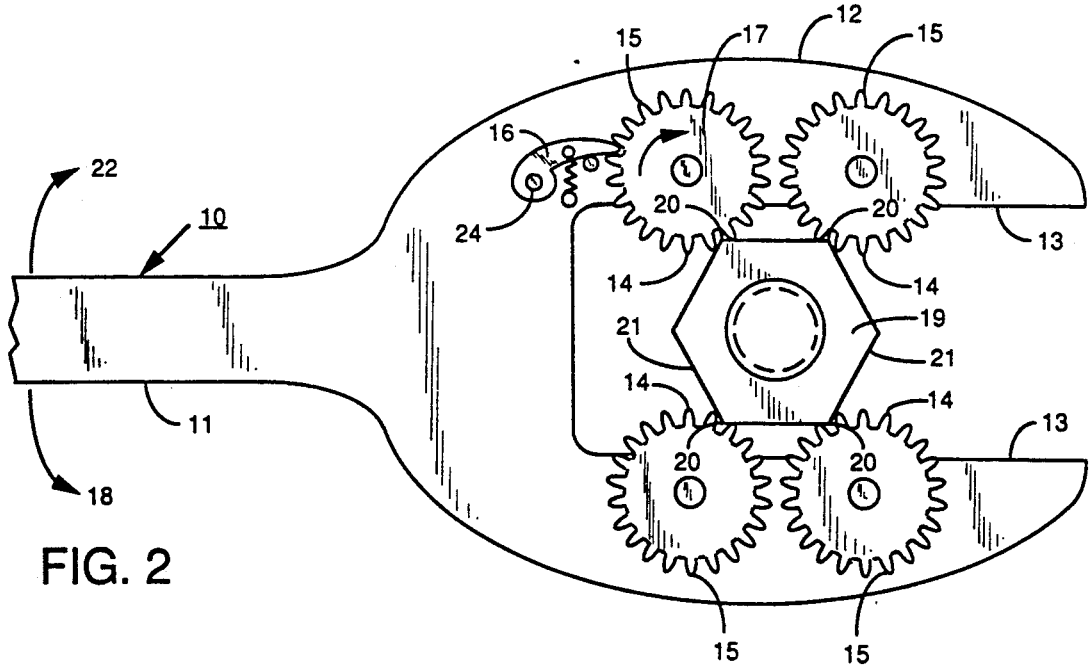
FIG. 2 is the same view of the tool shown in FIG. 1 with the exception that the gear jaws are shown embracing outside corners of the nut as opposed to the faces of the nut shown in FIG. 1.

Referring to FIGS. 1 and 2, the open-end ratchet wrench 10 of the present invention is illustrated in the form of an open-ended wrench which is provided with a handle 11 and a generally C-shaped head 12 at one end of the handle 11, which head provides a pair of open-ended jaws 13 with spaced confronting jaw faces 14. The jaw faces 14 are provided by rotatable toothed gears 15 which are presized and prealigned to engage and rotate about the angular corners and side surfaces of the nut 19, which is received between the gear jaws 14 for turning.

A conventional type ratchet device in the form of spring loaded dog 16, rotatable about pin 24, is also provided to permit rotation of gear 17 only in the clockwise direction as indicated by the arrow. A conventional reversable ratchet lever mechanism may be substituted for dog 16.

It should be noted that the gears 15 do not mesh with each other. This is necessary because as the toothed gear edges 14 of the jaws rotate about the irregular corner and flat face surfaces of nut 19, the gears 15 will necessarily rotate at different rates of speed, and therefore they should not be intermeshed.

The gears 15 are prepositioned for rolling over corners and faces of the nut 19 when the handle 11 is rotated in the counterclockwise direction as indicated by arrow 18. Additionally, the size and spacing of teeth 14 of the jaw gears is selected for engaging the corners 20 and/or the flat faces 21 of specific sized nut 19.

This is shown in FIG. 2 whereby the gears 14 are rolling over the corners 20 of nut 19, and in FIG. 1 the gears 14 are rolling over the flat faces 21 of nut 19.

It can thus be seen that it is necessary to provide sufficient play or slack to permit the gears to so rotate about these irregular surfaces.

However, when the handle 11 is rotated in a clockwise direction as indicated by arrow 22, dog 16 locks into the teeth 14 of gear 17 and prevents it from further rotating. The teeth of the gear 17 thus engage and are locked and levered against a corner 20 or a face 21 of nut 16, and nut 19 is thereby also forced to rotate in a clockwise direction.

When this clockwise rotation is stopped and the rotation is reversed in direction 18, the gear jaws 14 are then permitted to freely rotate about the irregular faces and corners of nut 19 to a new ratchet position.

If it is desired to rotate nut 19 in the opposite direction, one only needs to slip the wrench either upwardly or downwardly off of nut 19, pull it out and away, turn the wrench over and then reposition it over nut 19. Then, in this new position when the wrench is rotated, it will ratchet or turn the nut 19 in the opposite direction as explained previously in conjunction with FIGS. 1 and 2.

Figure 3:
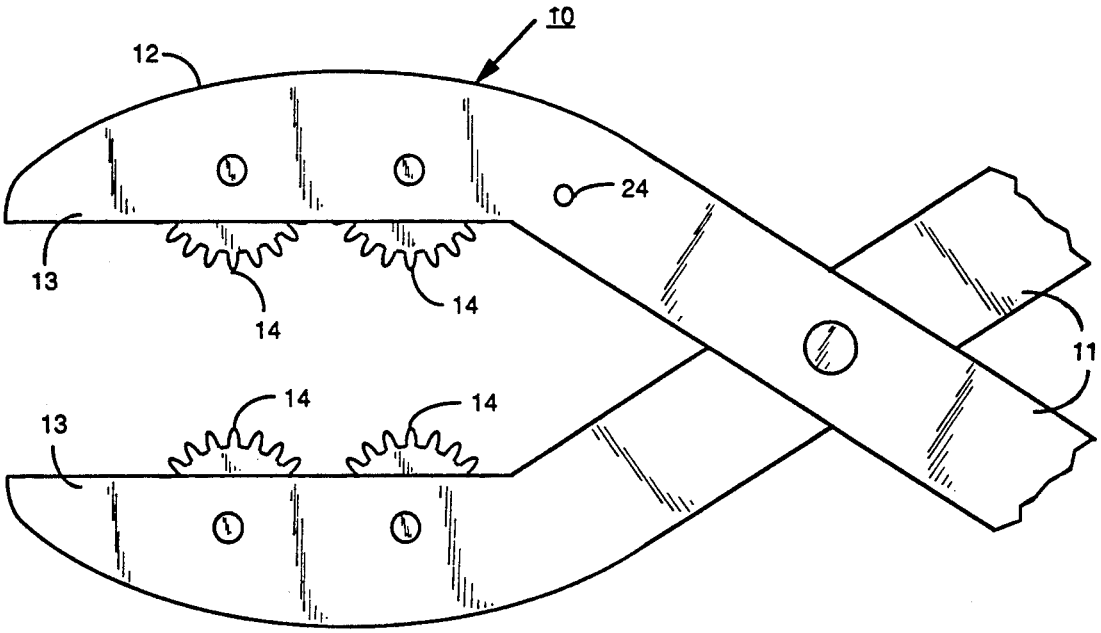
FIG. 3 is a view in side elevation of another embodiment of the novel tool of the present invention in the form of pliers.

FIG. 3 illustrates that the open-ended ratchet wrench of the present invention may be provided in many forms, and it is conceived that it may also be provided in the form of not only scissor-type pliers as illustrated in FIG. 3, but also in the form of slip-type pliers, vice-grip pliers and a crescent wrench.

In FIG. 3 the tool of the present invention is shown in the form of pliers and like parts are indicated with the same reference numerals.

The only difference is primarily that the handle 11 is here provided in the form of a pair of scissored handles 11 and the C-shaped jaw 12 is provided in the form of scissor jaws for the typical plier configuration.

The dog 16 is not illustrated in this figure since it is on the reverse side of the pliers illustrated. However, the pivot pin 24 for spring loaded dog 16 is shown.

I claim:

1. An open-end ratchet wrench having a pair of open-ended jaws with spaced confronting jaw faces and a support for said jaws, the improvement comprising: each jaw including a plurality of freely rotatable gears with circumferential gear teeth, portions of the gear teeth of each jaw constituting the confronting faces of the jaws, and ratchet means adapted to prevent rotation of at least one of said gears in one direction.

2. The open-end ratchet wrench of claim 1 wherein said gears are non-meshing.

3. The open-end ratchet wrench of claim 2 wherein each jaw consists of two prepositioned gears.

4. The open-end ratchet wrench of claim 1 wherein said ratchet means includes a spring loaded dog.

5. The open-end ratchet wrench of claim 1 wherein said wrench is in the form of pliers with pivotally adjustable jaws and handles.

6. The open-end ratchet wrench of claim 5 including means for adjustably spacing said jaws.

7. The open-end ratchet wrench of claim 1 wherein said gears are prepositioned for rolling over corners and faces of a given nut or bolt head.

8. The open-end ratchet wrench of claim 7 wherein the size and spacing of the teeth of said gears is selected for engaging corners or faces of a given size nut or bolt head.

9. An open-end ratchet wrench comprising: handle means, a generally C-shaped head at one end of said handle means providing a pair of open-ended jaws with spaced confronting jaw faces, said jaws having rotatable toothed gears presized and prealigned to engage and rotate about the angular side surfaces of a nut or bolt head to be received between said jaws for turning, and ratchet means for selectively preventing rotation of at least one of said gears in one direction.

10. The wrench of claim 9 wherein said gears are non-meshing.

11. The wrench of claim 10 wherein two gears are mounted on each jaw.

12. The wrench of claim 9 wherein the size and spacing of the teeth of said gears is preselected for engaging corners or faces of a given size nut or bolt head.

* * * * *